US006916233B2

(12) United States Patent
Nagashima

(10) Patent No.: US 6,916,233 B2
(45) Date of Patent: Jul. 12, 2005

(54) POLISHING AND CLEANING COMPOUND DEVICE

(75) Inventor: Toshio Nagashima, Sagamihara (JP)

(73) Assignee: TSC Corporation, Kanagawa (JP)

( * ) Notice: Subject to any disclaimer, the term of this patent is extended or adjusted under 35 U.S.C. 154(b) by 0 days.

(21) Appl. No.: 10/646,778

(22) Filed: Aug. 25, 2003

(65) Prior Publication Data

US 2004/0106364 A1 Jun. 3, 2004

(30) Foreign Application Priority Data

Nov. 28, 2002 (JP) ..... 2002-345348
Feb. 4, 2003 (JP) ..... 2003-026759

(51) Int. Cl.[7] ..... B24B 7/20
(52) U.S. Cl. ..... 451/178; 451/65; 451/190
(58) Field of Search ..... 451/178, 190, 451/194, 65; 156/345.12

(56) References Cited

U.S. PATENT DOCUMENTS 5,688,360 A * 11/1997 Jairath ..... 156/345.12
5,806,126 A * 9/1998 de Larios et al. ..... 15/102
5,853,522 A * 12/1998 Krusell et al. ..... 156/345.11
5,860,181 A * 1/1999 Maekawa et al. ..... 15/102
6,167,583 B1 * 1/2001 Miyashita et al. ..... 15/77
6,170,110 B1 * 1/2001 Svirchevski et al. ..... 15/77
6,200,201 B1 * 3/2001 Ravkin et al. ..... 451/65
6,328,640 B1 * 12/2001 Jones et al. ..... 451/194
6,347,977 B1 * 2/2002 Frost ..... 451/6
6,387,190 B1 * 5/2002 Aoki et al. ..... 134/28
6,405,399 B1 * 6/2002 Farber et al. ..... 15/77
6,457,199 B1 * 10/2002 Frost et al. ..... 15/77
6,488,573 B1 * 12/2002 Kobayashi et al. ..... 451/285
6,520,839 B1 * 2/2003 Gonzalez-Martin et al. .. 451/41
6,558,239 B2 * 5/2003 Kunisawa et al. ..... 451/303
6,616,516 B1 * 9/2003 Ravkin et al. ..... 451/194
6,733,596 B1 * 5/2004 Mikhaylichenko et al. .... 134/6
2002/0144710 A1 * 10/2002 Aoki et al. ..... 134/3
2002/0184720 A1 * 12/2002 Frost et al. ..... 15/77

FOREIGN PATENT DOCUMENTS

JP 11026419 A * 1/1999 ..... H01L/21/304
JP 2004047520 A * 2/2004 ..... H01L/21/304

* cited by examiner

*Primary Examiner*—David B. Thomas
(74) *Attorney, Agent, or Firm*—Wenderoth, Lind & Ponack, L.L.P.

(57) ABSTRACT

A polishing and cleaning compound device is provided which polishes and cleans a work piece in series, wherein cleaning is started while the polishing is being terminated. Thus, the polishing and cleaning compound device includes a polishing device unit having a pair of cylindrical polishing tools which vertically grip and hold a work piece transported from a container in which a plurality of thin disc-shaped work pieces are installed, the cylindrical polishing tools being rotated so as to pull the work piece up and polish the work piece as the work piece is rotated by rollers for rotation; and a cleaning device unit which is a circular shaped transporting mechanism and in which a plurality of holding devices hold the work pieces polished in the polishing device unit and move to a specific position in turn to clean the work piece. The polishing process is carried out by supplying abrasive and a cleaning process is carried out by supplying washing water.

12 Claims, 9 Drawing Sheets

2
3
4
5
6
6a
7
7a
7b
8
8a
9
9a
10
20
21
22
30
31
40
41

POLISHING AND CLEANING COMPOUND DEVICE

BACKGROUND OF THE INVENTION

This invention relates to a polishing and cleaning compound device which polishes and cleans both surfaces of a thin disc-shaped work piece in series such as a substrate for magnetic discs, a wafer, a glass substrate for a liquid-crystal display and a glass substrate for photomask.

JP 2002-254301 A discloses a polishing device which holds careers having a plurality of holes for holding a plurality of work pieces between upper and lower press pratens and makes them revolve and rotate on its own axis in normal and inverse directions alternatively to polish both sides of a plurality of work pieces.

JP 2001-144057 A discloses that, for example, a process for polishing surfaces of wafers is constituted of a plurality of polishing processes such as a rough polishing process, a precise polishing process, and a finish process, whose problem is to well remove slurry which is clung on wafers when the wafers are moved between the polishing stations. Accordingly, the patent reference discloses that the wafers are washed in a condition held on holding heads and washed in a condition installed on a holding base, and further, that the holding heads are washed independently.

Currently, there is a demand to polish a large number of thin disc-shaped work pieces such as wafers, and up to now, as disclosed in JP 2002-254301 A, a plurality of work pieces are polished once by making a plurality of careers each of which can receive a plurality of work pieces and revolve and rotate on its axis between the upper and the lower press pratens which have polishing surfaces rotating on their axes and on which slurry is supplied. In this case, when the work pieces are taken out after polishing, polished surfaces of the work pieces are changed by the slurry clung thereon, so that a disadvantage arises in that the work pieces must be taken out as soon as possible and qualities of the work pieces are changed according to an order in which the work pieces are taken out.

In addition, as disclosed in JP 2001-144057 A, it is preferable that removal of the slurry is carried out every polishing process, but as a result, a disadvantage arises in that the process is complicated. Furthermore, a disadvantage arises in that abrasive cloth is hardened because of a time interval between the polishing process and the cleaning process, such that a problem of a decrease in a quality of polishing arises.

SUMMARY OF THE INVENTION

An object of the invention is to provide a polishing and cleaning compound device in which polishing and cleaning of work pieces can be carried out continuously.

Accordingly, the present invention is that, in a polishing and cleaning compound device in which a polishing device unit for polishing thin disc-shaped work pieces and a cleaning device unit for cleaning the work pieces polished in the polishing device unit are located in series, the polishing device unit is constituted of at least a pair of cylindrical polishing tools on which abrasive cloths are arranged respectively and at least one roller for rotation for limiting an upper position of the work piece and for rotating the work piece on its axis, and further comprises a first holding means for gripping and holding a work piece, which is transported from a container for installing a plurality of work pieces in turn, in a vertical direction by the pair of the cylindrical polishing tools, and a polishing means for making the work piece held by the first holding means rotate in its axis by the roller for rotation and for rotating the pair of the cylindrical polishing tools so as to bring up the work piece.

Besides, the present invention is that, in a polishing and cleaning compound device in which a polishing device unit for polishing thin disc-shaped work pieces and a cleaning device unit for cleaning the work pieces polished in the polishing device unit are located in series, the cleaning device unit comprises second holding means each of which holds a work piece transported from the polishing device unit in turn, a circle-shaped transport means in which the second holding means are arranged equally on circumference thereof, and a cleaning means which comprises a pair of cleaning tools located so as to grip the work piece and make the pair of the cleaning tools rotate and the work piece rotate in its axis.

Furthermore, the present invention is that, in a polishing and cleaning compound device in which a polishing device unit for polishing thin disc-shaped work pieces and a cleaning device unit for cleaning the work pieces polished in the polishing device unit are located in series, the polishing device unit is constituted of at least a pair of cylindrical polishing tools on which abrasive cloth is arranged and at least one roller for rotation for limiting an upper position of the work piece and for rotating the work piece on its axis, and further comprises a first holding means for griping and fixing a work piece, which is transported from a container for installing a plurality of work pieces in turn, in a vertical direction by the pair of the cylindrical polishing tools, and a polishing means for making the work piece held by the first holding means rotate in its axis by the roller for rotation and for rotating the pair of the cylindrical polishing tools so as to bring up the work piece; and the cleaning device unit comprises second holding means each of which holds a work piece transported from the polishing device unit in turn, a circle-shaped transport means in which the second holding means are arranged equally on circumference thereof, and a cleaning means which comprises a pair of cleaning tools located so as to grip the work piece and make the pair of the cleaning tools rotate and the work piece rotate in its axis.

Roughly speaking, in a polishing device unit of a polishing and cleaning compound device, a work piece transported from a container in which a plurality of thin disc-shaped work pieces are installed in turn is gripped and fixed in a vertical direction by a pair of cylindrical polishing tools, being rotated in its axis by the rollers for rotation, being polished by making the pair of the cylindrical polishing tools rotate so as to bring the work piece up. Besides, in a cleaning device unit, the work pieces polished by the polishing device unit are held in turn by a plurality of second holding means arranged on circumference of a circle-shaped transporting mechanism, and then the work pieces are moved to a specific position for cleaning in turn and cleaned by a pair of cleaning tools arranged so as to grip the work piece.

Moreover, it is preferred that the second holding means comprises a plurality of rollers for rotation which are in contact with a circumference edge of the work piece.

Furthermore, it is preferred that the pair of the cylindrical polishing tools are in contact with the work piece linearly at a position with a specific value lower than a horizontal reference line passing through a center point of the work piece and in parallel with the horizontal reference line.

Besides, it is preferred that the pair of the cylindrical polishing tools are in contact with the work piece linearly at a position with a specific value lower than a horizontal reference line passing through a center point of the work piece with inclination to the horizontal reference line at a specific angle, it is preferred that the specific angle is within 5–40°, especially within 10–20°.

It is preferred that at least one roller for rotation in the polishing device unit makes the work piece move (reciprocate) or revolve elliptically so that a center of the work piece passes through an area in contact with the cylindrical polishing tools. Thus, in the case that the work piece is thin disc-shaped and does not have an opening at a center thereof, it is possible to polish evenly as a whole.

Another object of the invention is to provide a polishing and cleaning compound device which can carry on cleaning at the same time that polishing is finished.

Accordingly, the present invention is that a polishing and cleaning compound device comprises at least a transport means for transporting thin disc-shaped work pieces, polishing tools for polishing a work piece transported by the transport means and a drive means for driving the polishing tools to the work piece, driving the polishing tools to the work piece by the drive means, carrying out a polishing process in which abrasive material is poured into the polishing tools and a cleaning process in which cleaning water is poured into the polishing tools continuously.

Therefore, because there is no time interval from the polishing process to the cleaning process, the above problem can be achieved.

Furthermore, it is preferred that the polishing process and the cleaning process are overlapped at a specific time to be carried out. Thus, shift from the polishing process to the cleaning process can be carried out smoothly.

Moreover, the polishing tools are a pair of cylindrical polishing tools in which abrasive cloth is arranged, the work piece transported by the transport means is gripped and fixed in a vertical direction to be rotate, the pair of the cylindrical polishing tools is rotated so as to bring the work piece up, the polishing process is carried out by pouring abrasive material into the pair of the cylindrical polishing tools, and the cleaning process is carried out by pouring cleaning water into the pair of the cylindrical polishing tools.

Besides, it is preferred that the transport means takes out a work piece from a container in which the work pieces are installed in turn to transport it, and transports the polished and cleaned work piece to next processes in turn.

BRIEF DESCRIPTION OF THE DRAWINGS

The various features of novelty which characterize the invention are pointed out with particularity in the claims annexed to and forming a part of this specification. For a better understanding of the invention, its operating advantages, and specific objects attained by its use, reference should be had to the accompanying drawings and descriptive matters in which there are illustrated and described preferred working modes of the invention.

FIG. 2A illustrates a front schematic diagram and FIG. 2B illustrates a side schematic diagram;

FIG. 3A illustrates a front schematic diagram and FIG. 3B illustrates a side schematic diagram;

FIG. 6A illustrates a case that rollers for rotation in the polishing device unit according to the first working mode are made to move up and down, and FIG. 6B illustrates a case that one roller for rotation in the polishing device unit according to the second working mode is made to rotate regarding another roller for rotation as a fulcrum;

FIG. 7A illustrates a case that rollers for rotation in the polishing device unit according to the first working mode are made to rotate elliptically in order to make a work piece rotate elliptically, FIG. 7B illustrates a case that rollers for rotation in the polishing device unit according to the second working mode are made to rotate elliptically in order to make a work piece rotate elliptically;

DETAILED DESCRIPTION OF THE INVENTION

Figure 1:
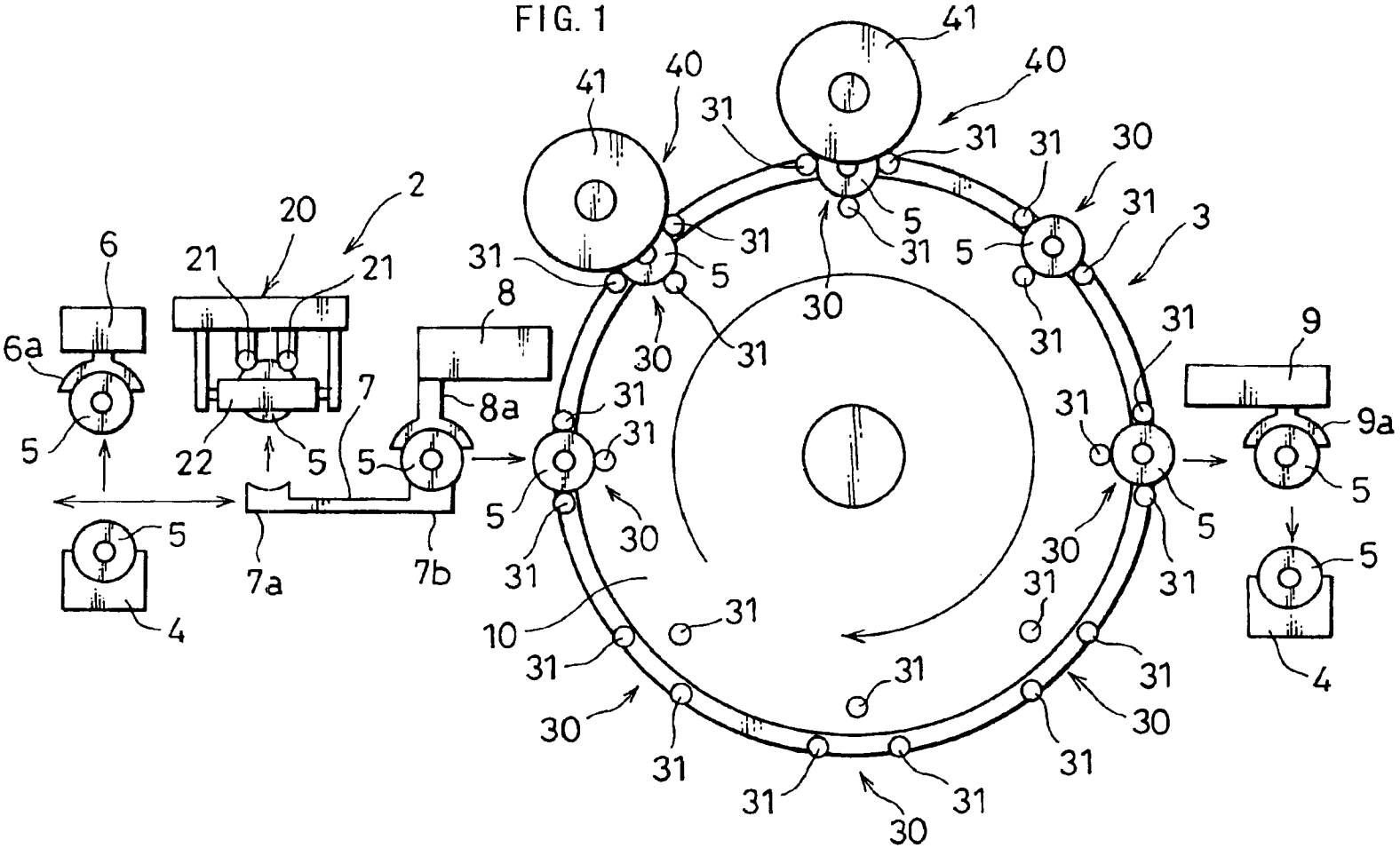
FIG. 1 is a schematic diagram of a polishing and cleaning compound device according to a first working mode of the present invention.

Hereinafter, the best working modes of the invention are explained according to the drawings.

A polishing and cleaning compound device 1 according to a working mode of the present invention includes at least a polishing device unit 2 and a cleaning device unit 3.

A thin disc-shaped work piece 5 such as a substrate for a magnetic disc, a semiconductor wafer, a glass substrate for liquid-crystal display, and a glass substrate for a photomask which is installed in a container 4 is gripped by a grip 6*a* of a lift mechanism 6 and lifted up from the container 4. A career 7 moves to a position where a first holder 7*a* of the career 7 reaches under the grip 6*a*, and in this position, the career 7 moves up to receive the work piece 5 on the first holder 7*a* from the grip 6*a*.

Figure 2A:
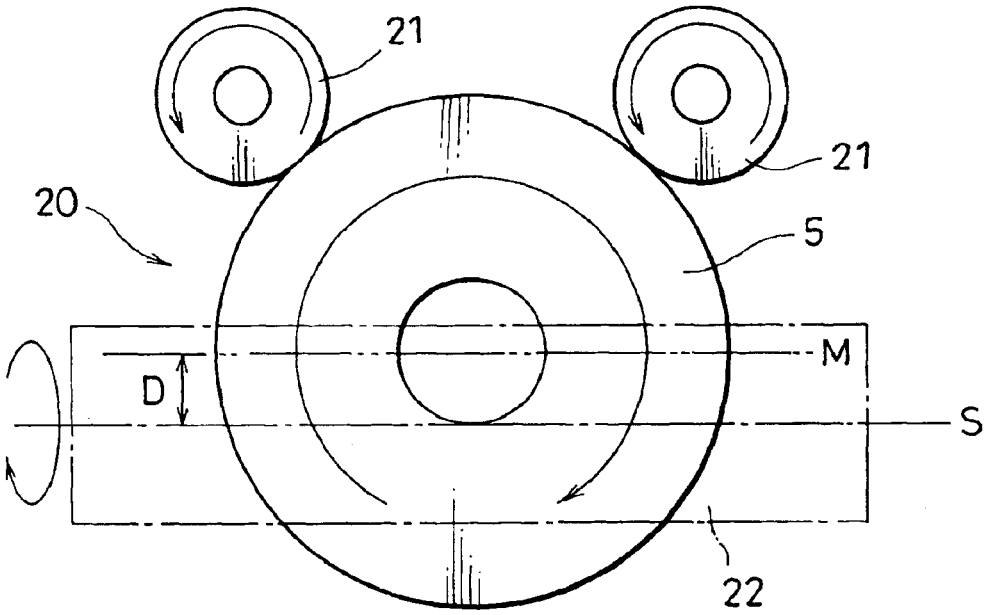
FIGS. 2A and 2B are schematic diagrams of a polishing device unit according to the first working mode.
Figure 2B:
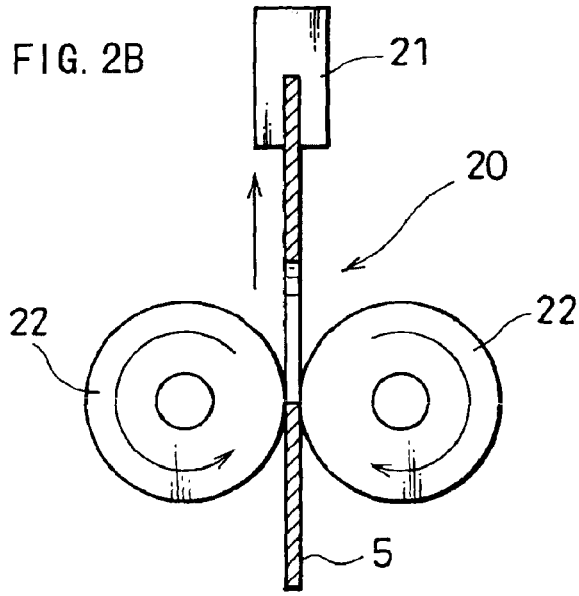

After the work piece 5 is set on the first holder 7*a*, the career 7 moves horizontally to a position where the first holder 7*a* reaches under a polishing mechanism 20, and in the position, the career moves up. The polishing mechanism 20 holds the work piece moving up with the career The polishing mechanism 20 comprises, as shown in FIGS. 2A and 2B, at least a pair of rollers for rotation 21 which limits an upper position of the work piece 5 and makes the work piece 7 rotate on its axis, and a pair of cylindrical polishing tools 22 which are rotated so as to urge the work piece 5 upward. Each of the cylindrical polishing tools 22 has a cylindrical shape and is provided with a polishing cloth on an outer surface thereof. The cylindrical polishing tools 22 are in contact with both sides of the work piece 5 in a linear contact position (hereinafter a contact line S) below a specific value D from a center reference line M passing through a center point of the work piece 5, respectively. Thus, a power holding the work piece 5 in the polishing mechanism 20 and polishing performance in the work piece 5 can be increased in comparison with the case that a contact line S is similar to the center reference line M.

In the above constitution, the cylindrical polishing tools 22 grip the work piece at the contact line S and rotate so as to urge the work piece 5 upward, and further, the rollers for rotation 21 make the work piece 5 rotate on its axis, so that both sides of the work piece 5 can be polished. Note that in this polishing process, slurry with specific characteristics is supplied to a polishing cloth provided on the outer surfaces of the cylindrical polishing tools 22.

After the polishing process, the career 7 moves to the left in FIG. 1, and the first holder 7*a* receives a new work piece 5 while a second holder 7*b* of the career 7 receives the polished work piece 5 from the polishing mechanism 20, and then, the career 7 moves to the right in FIG. 1. Next, the polished work piece 5 is transported from the second holder 7*b* to the cleaning device unit 3 by a grip 8*a* of a transport mechanism 8.

The cleaning device unit 3 comprises a circle-shaped transporting mechanism 10 which has a plurality of holding mechanisms 30 arranged at specific intervals on a circumference thereof, and at least one cleaning mechanism 40 (in this working mode, two cleaning mechanisms) which is provided at a specific position of the circle-shaped transporting mechanism 10. The circle-shaped transporting mechanism 10, which is constituted as a Ferris wheel shape, rotates the work pieces 5 gripped by the holding mechanisms 30 at every specific angle (in this working mode, 45°) to transport the work pieces 5 to the cleaning mechanism 40, and after cleaning, further transports the work pieces 5 to the transporting mechanism 9 while drying the work pieces 5 in turn.

Each of the holding mechanisms 30 in the cleaning device unit 3 is constituted of three holding rollers 31 which hold the work piece 5 at at least three points. In this case, a power holding the work piece 5 can be increased by applying a rotation power to the holding rollers 31 located on both sides so as to urge the work piece 5 to the holding roller 31 located in the middle.

Figure 3A:
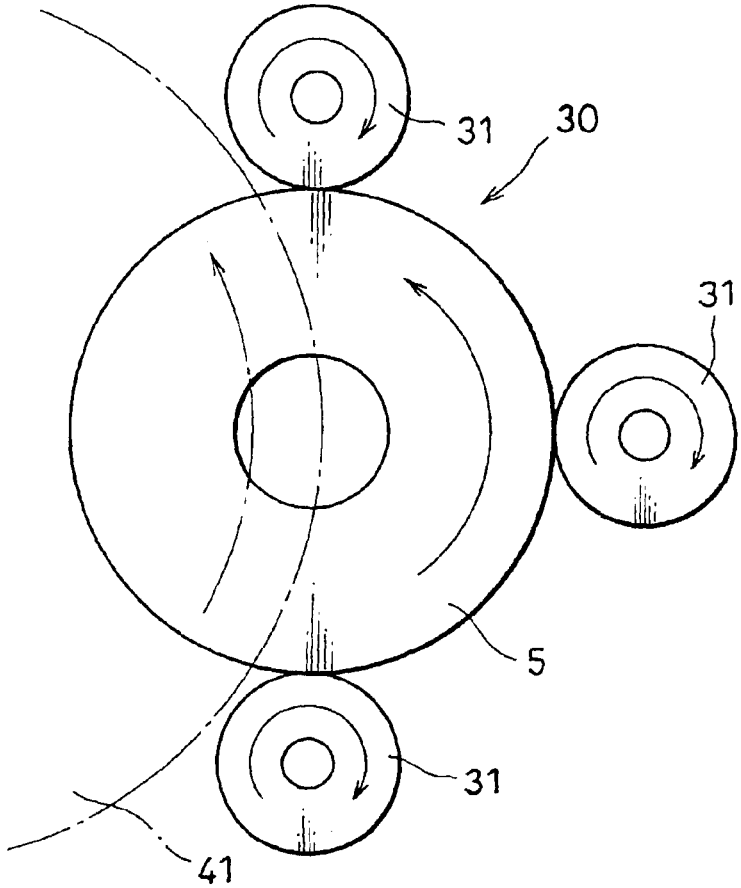
FIGS. 3A and 3B are schematic diagrams of a cleaning device unit according to the first working mode.
Figure 3B:
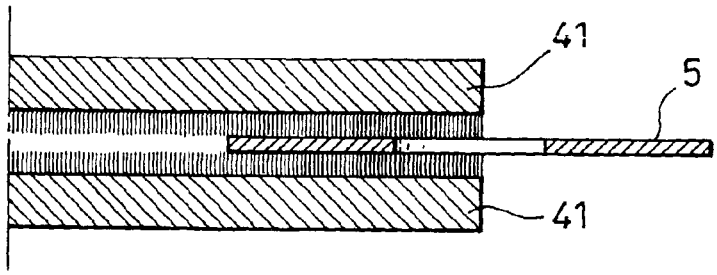

The cleaning mechanism 40 is, as shown in FIGS. 3A and 3B, constituted of a pair of cleaning tools 41 which grip the work piece 5 and rotate in their axes respectively, and a rotation mechanism for rotating the work piece 5 in the axis by driving the holding rollers 31. In a cleaning process by the cleaning tools 41, washing water is supplied to remove particles such as slurry clung on the work piece 5. Note that, in this working mode, the holding rollers 31 are driven actively by a means for driving, but the holding rollers 31 are designed to a rotatable constitution without a means for driving, so that the work piece 5 can be rotated in its axis with rotation of the cleaning tools.

The polished and cleaned work piece 5 transported to a specific position with the circle-shaped transporting mechanism 10 rotating is transferred from the holding mechanism 30 by a grip 9*a* of the transporting mechanism 9 to be installed into the container 4.

Thus, in the polishing and cleaning compound device 1 according to the present invention, the work pieces 5 installed in the container 4 can be polished and cleaned in series, and then, installed into the container 4 again, so that constant quality can be maintained and productivity can be increased.

Figure 4:
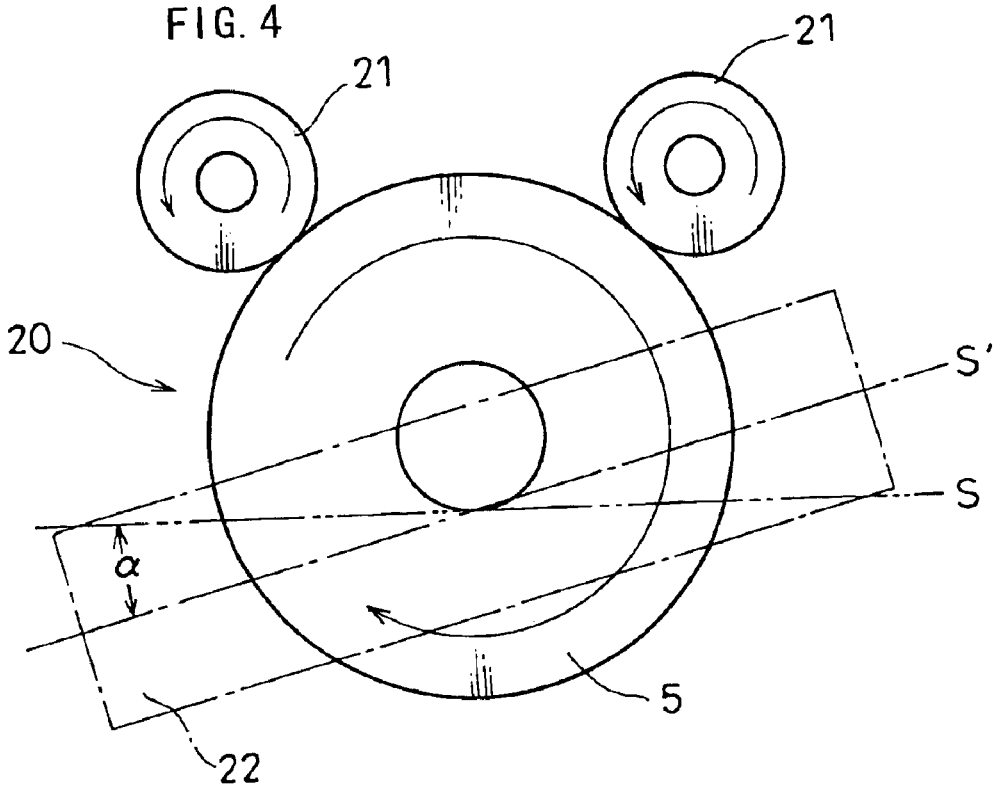
FIG. 4 is a front schematic diagram of a polishing device unit according to a second working mode of the present invention.

The polishing mechanism 20 according to another working mode shown in FIG. 4 is characterized in that the contact line S' of the pair of the cylindrical polishing tools 22 is inclined at a specific angle ($\alpha$) to the above-mentioned contact line S.

Figure 5:
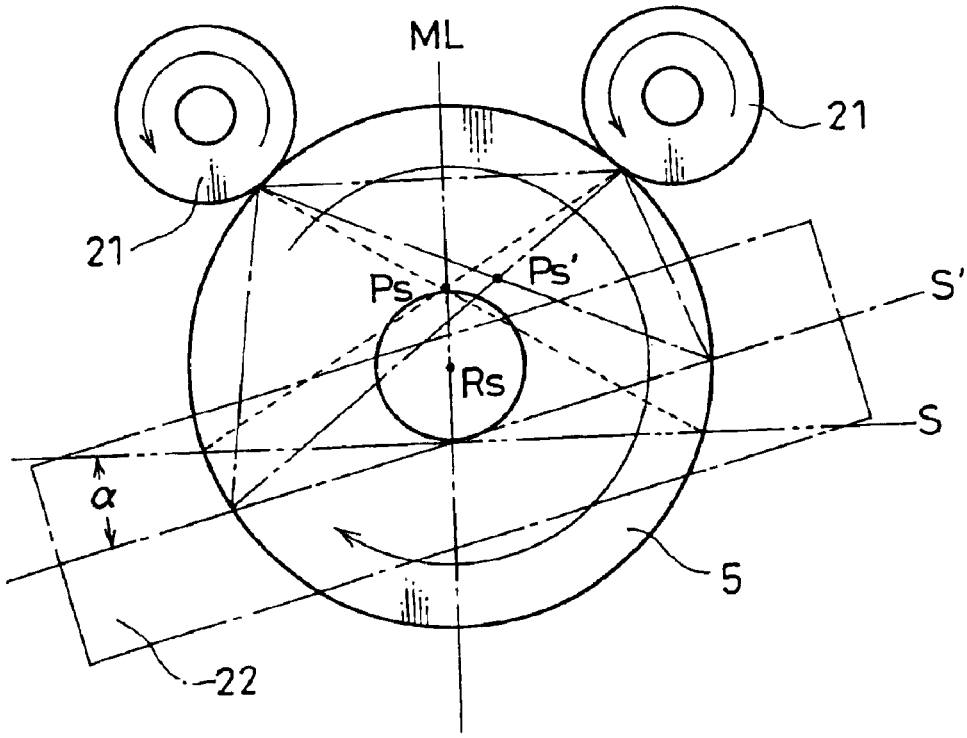
FIG. 5 is an explanatory drawing which illustrates an actuating condition of the polishing device unit according to the second working mode.

This shows, for instance, as shown in FIG. 5, that a cross point Ps where contact points between the rollers for rotation 21 and the work piece 5 is connected with a contact line between the cylindrical polishing tools 22 and the work piece 5 in the above-mentioned working mode is positioned on a vertical line ML passing through a rotation center point Rs of the work piece 5, but a cross point Ps' where contact points between the rollers for rotation 21 and the work piece 5 is connected with a contact line between the cylindrical polishing tools 22 and the work piece 5 in this working mode exists at a position being off from the vertical line ML passing through the rotation center point Rs of the work piece 5. In this working mode, a triangle shape formed by connecting the contact point between one roller for rotation 21 and the work piece 5 with the contact line between the cylindrical polishing tools 22 and the work piece 5 is not similar to a triangle shape formed by connecting the contact point between another roller for rotation 21 and the work piece 5 with the contact line between the cylindrical polishing tools 22 and the work piece 5.

Due to the above factors, because swinging of the work piece 5 can be prevented, polishing precision can be increased more than the above mentioned first working mode and polishing performance can be steadied. It is preferred that the angle a is within 5–40°, and especially within 10–20°.

Figure 6A:
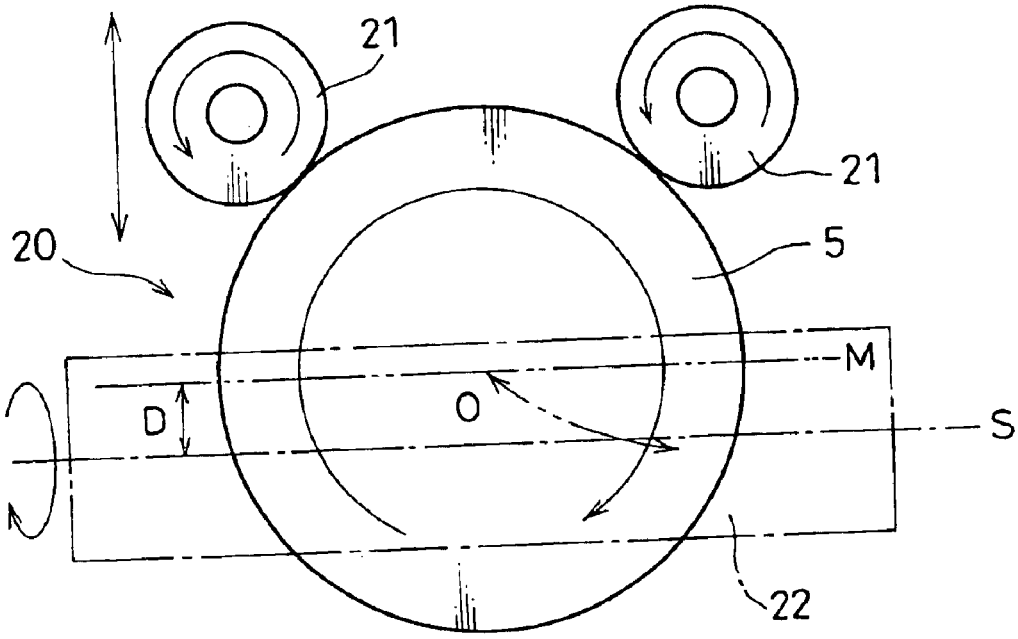
FIGS. 6A and 6B show a polishing device unit according to a third working mode.
Figure 6B:
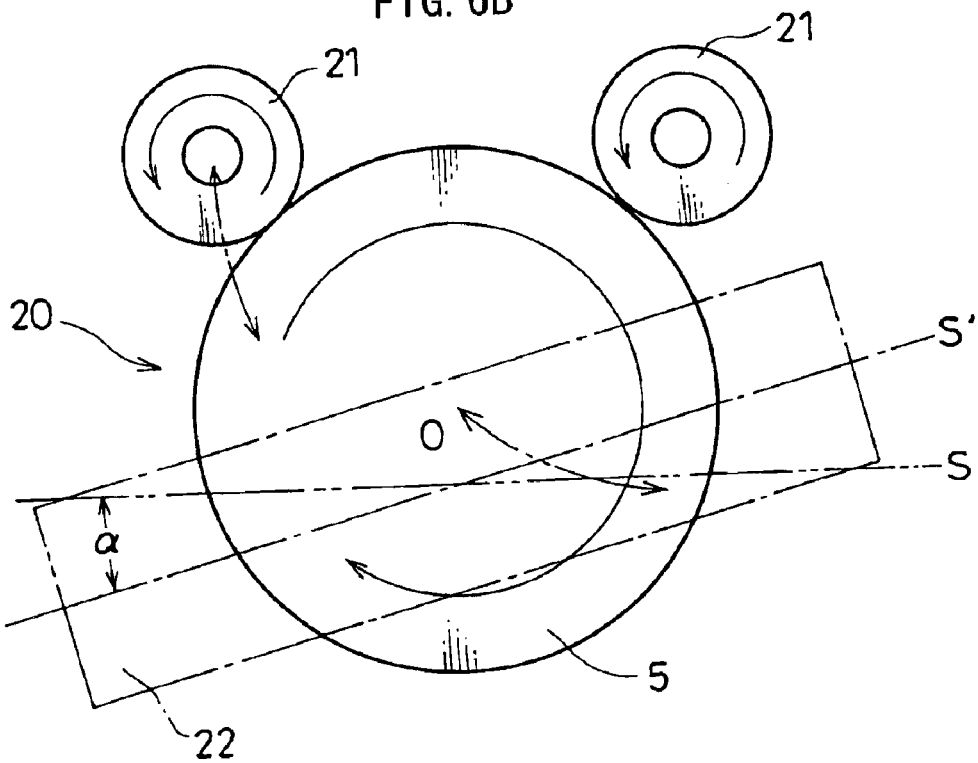

In a polishing mechanism 20 according to a third working mode as shown in FIGS. 6A and 6B, at least one roller for rotation 21 constituting a part of the polishing mechanism 20 according to the first and the second working modes is moved up and down (FIG. 6A) or circularly (FIG. 6B), so that the work piece 5 is moved (or reciprocated) circularly regarding an another roller for rotation 21 as a center of rotation to make a center of the work piece pass through a polishing area of the pair of the cylindrical polishing tools 20 which are in contact with the work piece 5 linearly. Thus, for instance, in the case that a work piece 5 has no openings in a center thereof, good polishing performance can be maintained.

Figure 7A:
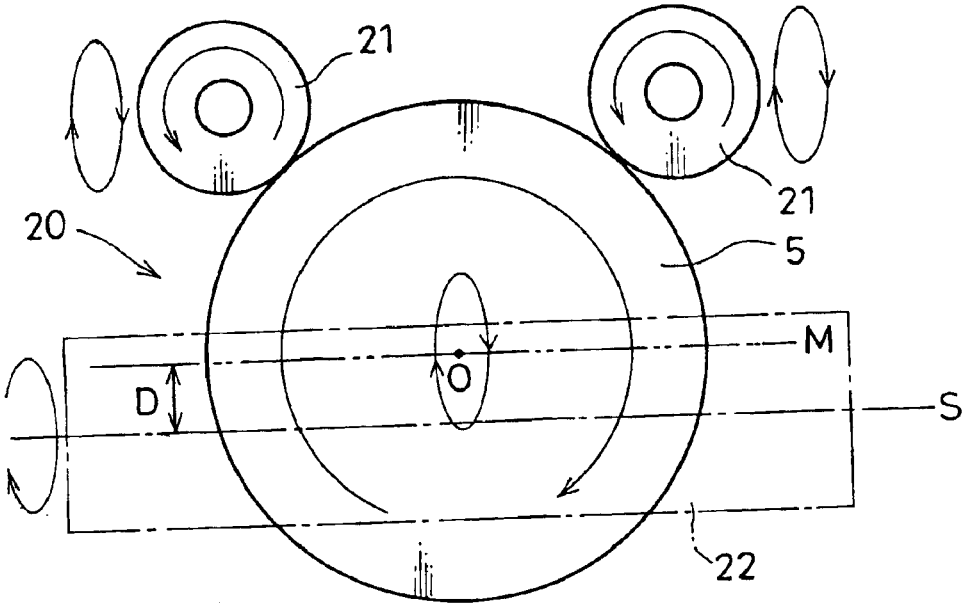
FIGS. 7A and 7B show a polishing device unit according to a fourth working mode.
Figure 7B:
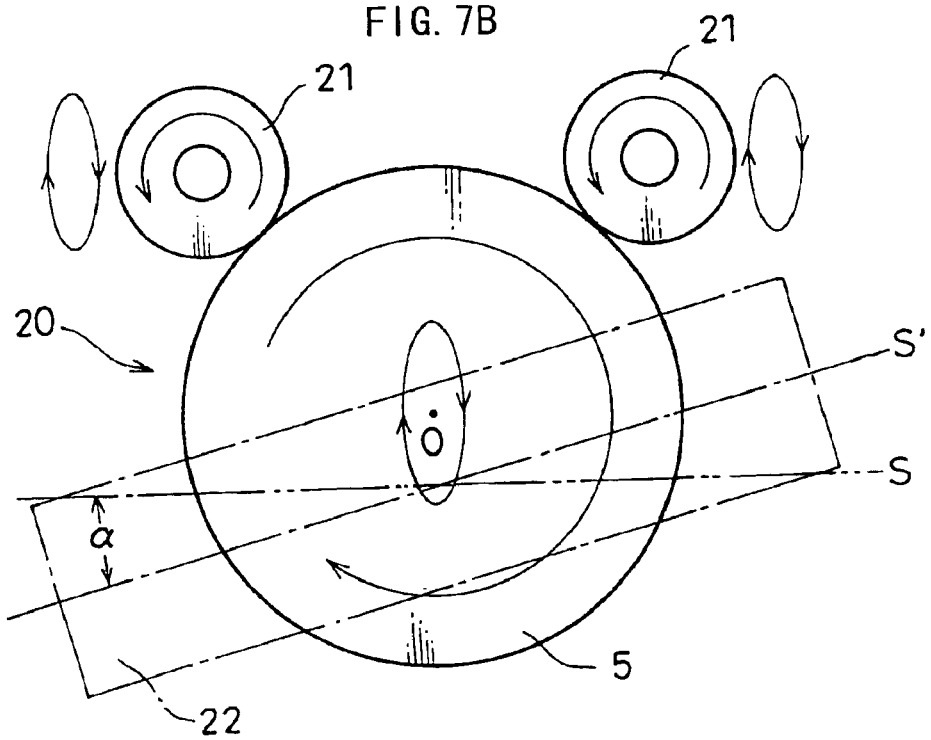
Figure 8:
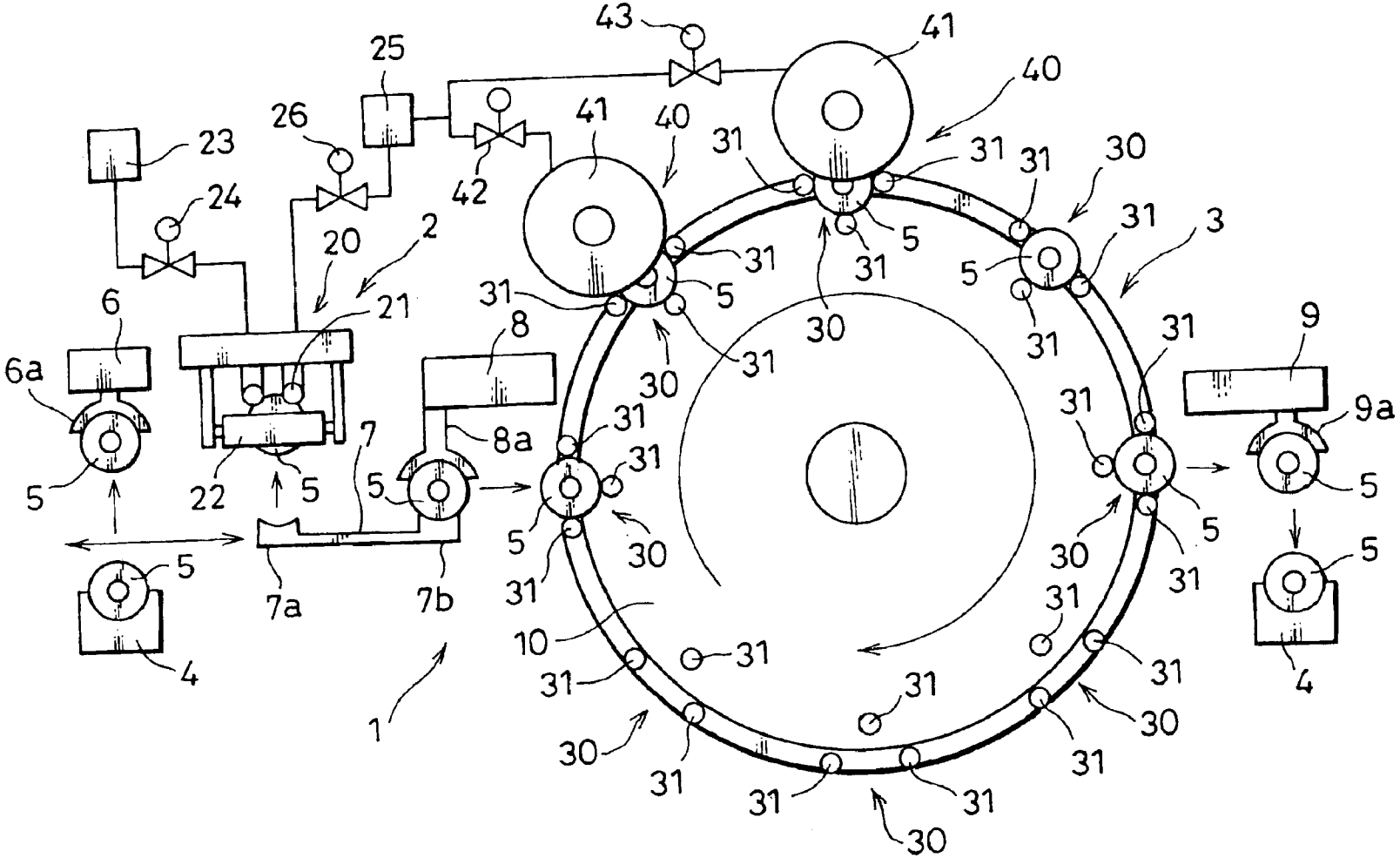
FIG. 8 is a schematic diagram of a polishing and cleaning compound device according to a fifth working mode of the present invention.

Furthermore, in a polishing mechanism according to a fourth working mode as shown in FIGS. 7A and 7B, rollers for rotation constituting a part of the polishing mechanism 20 according to the first and second working modes are rotated elliptically to make the work piece 5 undergo elliptical rotation, so that a center of the work piece 5 is passed through a polishing area of the pair of the cylindrical polishing tools which are in contact with the work piece 5 linearly. Thus, for instance, in the case that a work piece 5 has no openings in a center thereof, good polishing performance can be maintained, the same as the above mentioned third working mode. Thus, if the center of the work piece 5 is moved so as to pass through the polishing area of the cylindrical polishing tools 22, movement of the rollers for rotation 21 is not especially limited.

Also, by moving the rollers for rotation 21 so as to push the work piece 5 down against a rotation power of the cylindrical polishing tools 22 and then return to the original positions thereof at the moment, the center of the work piece 5 can be passed through the polishing area of the cylindrical polishing tools 22. Furthermore, at this time, though the work piece 5 moves horizontally at the moment, the horizontal movement of the work piece 5 can make a polished condition near the center of the work piece 5 better.

A polishing and cleaning compound system 1 according to the fifth working mode is constituted of at least a polishing and cleaning compound device 2, a device for cleaning only 3 and transport devices (6,7,8,9,10) the same as mentioned above.

In the polishing and cleaning compound system 1 according to the fifth working mode, the polishing/cleaning mechanism 20 is provided with a tank for hosing abrasive 23 with an on-off valve 24 and a tank for washing water 25 with an on-off valve 25, wherein a polishing process is carried out when the abrasive with any specific characteristics is supplied to polishing cloths provided on side surfaces of the cylindrical polishing tools 22 by turning the on-off valve 24 on and a cleaning process is carried out when the washing water is supplied to the polishing cloths by turning the on-off valve on.

After processes in the polishing/cleaning mechanism 20, cleaning the work piece 5 is carried out in the device for cleaning only 3 similarly to the above working modes, and finally the work piece 5 is installed in the container 4. Hereinafter, in this working mode, the same reference numbers are marked on parts in this working mode similar to ones in the above working modes to omit explanation thereof, and actions of the polishing/cleaning mechanism 20 are explained especially.

Figure 9:
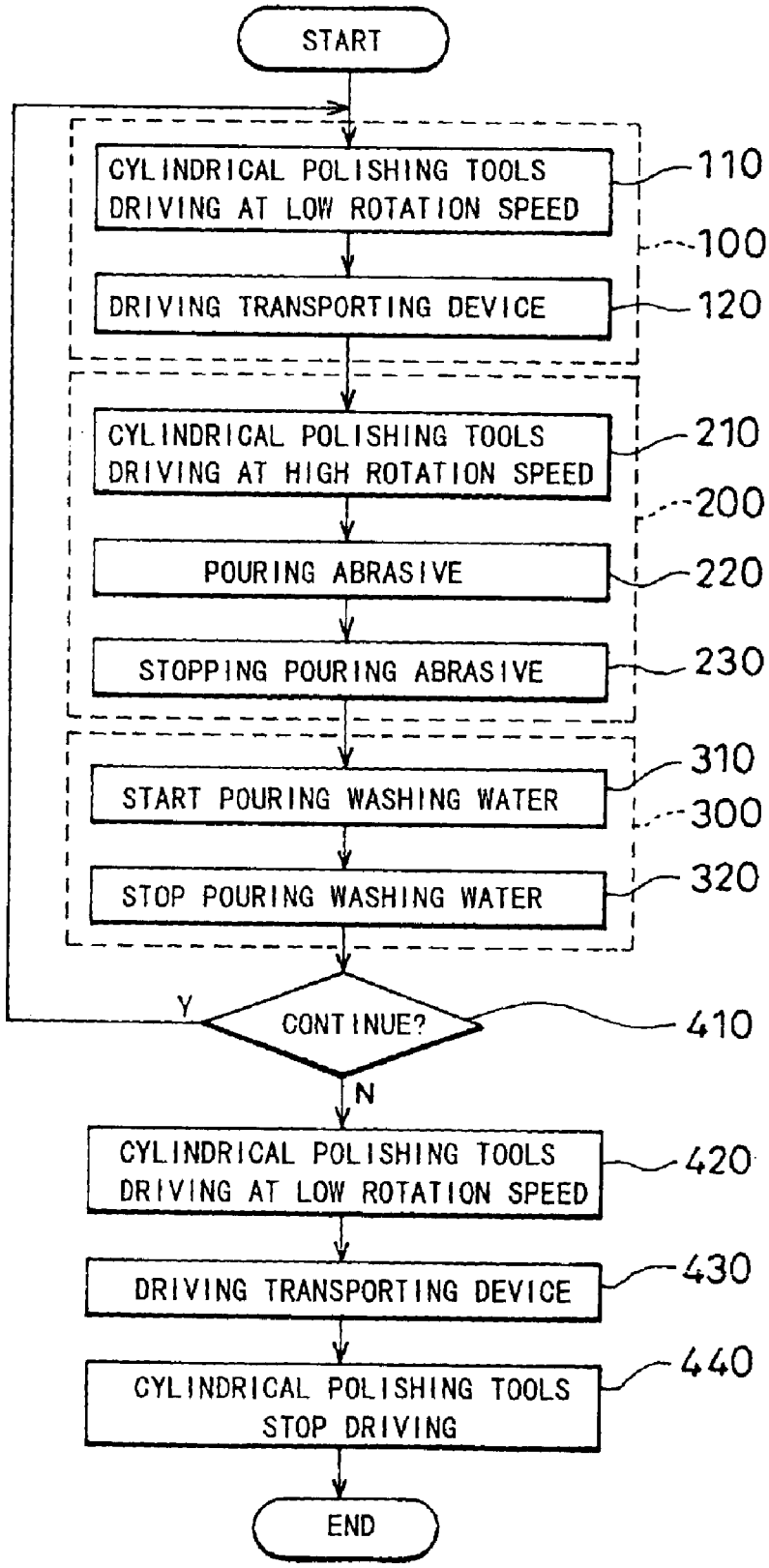
FIG. 9 is a flowchart diagram showing a control of a polishing/cleaning process according to the fifth working mode of the present invention.

In the polishing and cleaning compound system 1 according to the fifth working mode, an operation, for instance, as shown in a flowchart of FIG. 9 is carried out in the polishing/cleaning mechanism 20. This operation is started by turning on a main switch, etc, not shown in figures.

Firstly, the cylindrical polishing tools 22 is driven at a low rotation speed in step 100, and then, in step 120, the transporting devices 6, 7 are driven in order to hold the work piece 5 between the cylindrical polishing tools 22 rotating at the low rotation speed. These steps 110 and 120 constitute a preparation stage 100.

After holding the work piece 5, the cylindrical polishing tools 22 are driven at a high rotation speed in step 210, the abrasive is poured on the polishing cloths of the cylindrical polishing tools 22 by turning on the on-off valve 24 in step 220, so that a polishing stage 200 of the work piece 5 is carried out. The polishing stage 200 is terminated by turning off the on-off valve 24 to stop pouring the abrasive, and a cleaning stage 300 is started by turning on the on-off valve 26 to pour washing water. The cleaning stage 300 is terminated by turning off the on-off valve 26 to stop pouring the washing water.

Thus, the present invention is characterized in that the polishing stage is carried out by pouring the abrasive and the cleaning stage is carried out by pouring the washing water while the cylindrical polishing tools 22 rotate, that is to say, the cleaning stage is started while the polishing stage is being terminated. Accordingly, a disadvantage which arises from a time gap between the termination of the polishing stage and the start of the cleaning stage, such as to change the polished surface by the abrasive clung on the work piece, can be prevented, so that a quality thereof can be increased.

Next, a continuation of working in step 410 is judged, and in the case that the working is continued (Y), the processes from step 110 to step 320 are carried out repeatedly by returning to step 110, so that polishing of the work pieces 5 is carried out in series. In step 410, in the case that it is judged that working is not continued (N), the cylindrical polishing tools are driven at a low rotation speed in step 420, the transporting device 6, 7 are driven in step 430 to transport the last working piece 5 to the next process, and then the cylindrical polishing tools 22 are stopped in step 440 to terminate the working in the polishing/cleaning mechanism 20.

Figure 10:
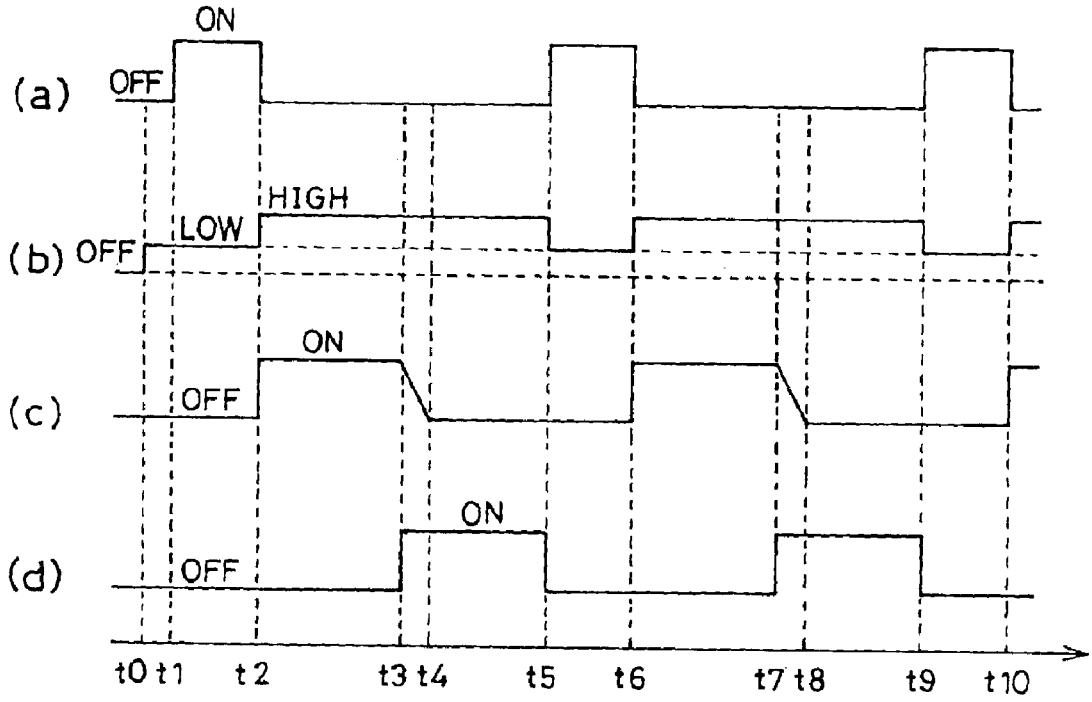
FIG. 10 is a timing chart diagram showing a control of a polishing/cleaning process according to the fifth working mode of the present invention.

FIG. 10 illustrates a timing chart diagram of the above mentioned working. In this drawing, (a) shows a driving condition of the transporting devices 6, 7, (b) shows a rotation condition of the cylindrical polishing tools 22, (c) shows a condition of pouring the abrasive by the on-off valve 24, and (d) shows a condition of pouring the washing water by the on-off valve 26.

In FIG. 10, the cylindrical polishing tools 22 are driven at a low rotation speed (LOW) at t0, and the transporting device 6, 7 are driven at t1, t5 and t9 to transport the work piece 5, so that the work piece 5 is installed in the polishing/cleaning mechanism 20. After installing the work piece 5, while the cylindrical polishing tools 22 are driven at a high rotation speed (HIGH) at t2, t6, and t10, pouring of the abrasive is started to carry out the polishing process. After a specific time, pouring of the abrasive is stopped while the washing water is poured to carry out the cleaning process, pouring of the washing water is stopped to terminate the cleaning process at t5 and t9, and then the transporting devices 6, 7 are driven. In the working mode shown in FIG. 10, the polishing process is from t2, t6 to t4, t8, the cleaning process is from t3, t7 to t5, t9, so that the polishing process and the cleaning process are overlapped between t3, t8 and t5, t9. This is to show that pouring of the abrasive is continued by the remains of the abrasive that is poured at a specific time after close of the on-off valve 24, but this overlap is effective for shifting from the polishing process to the cleaning process smoothly, so that it is preferred that the on-off valve 26 for pouring the washing water be turned on at the same time as turning off the on-off valve 24.

As explained above, according to this invention, the polishing device unit and the cleaning device unit are arranged in series and the polishing process and the cleaning process are carried out in series in turn, so that continuous workings become possible, as a result, the quality and the productivity of the work pieces can be increased.

In addition, in the cleaning process, the front and the back surface of the polished work piece are not gripped, but the circumferential edge of the work piece is held at points thereof, so that the quality of the work piece can be increased.

Furthermore, according to this invention, because the cleaning process is started by changing from pouring the abrasive to pouring the washing water without stopping machines from the polishing process, the abrasive does not remain on the polished surfaces thereof, so that a disadvantage by clinging of the abrasive can be avoided. In addition, dressing of the polishing cloths can be carried out by pouring the washing water at the same time, and a surface of the polishing cloth can be held in a good condition. As a result, quality of polishing can be maintained for a long time.

What is claimed is:

1. A polishing and cleaning compound system comprising:

a polishing device unit operable to polish a thin disc-shaped work piece;

a cleaning device unit arranged in series with said polishing device; and a transporting mechanism operable to transport the work piece from a container which installs a plurality of the work pieces to said polishing device unit and said cleaning device unit in turn, wherein said polishing device unit comprises:

a pair of cylindrical polishing tools which are in contact with the work piece linearly at a position with a specific value lower than a horizontal reference line passing through a center point of the work piece with an inclination to the horizontal reference line at a specific angle;

a first holder operable to vertically grip and hold the work piece transported from the container in which the plurality of the work pieces are installed; and at least two first rollers operable to rotate which are arranged above said cylindrical polishing tools to limit an upper position of the work piece and to make the work piece rotate along its axis and to make the work piece move such that a center of the work piece crosses a contact area of said cylindrical polishing tools;

wherein said pair of said cylindrical polishing tools are rotated so as to pull the work piece toward said first rollers for rotation, wherein said first rollers are rotated and moved, and wherein a polishing process is carried out by pouring abrasive toward said pair of cylindrical polishing tools.

2. A polishing and cleaning compound system according to claim 1, wherein movement of said first rollers is an elliptical movement such that a center of the work piece crosses a contact area of said cylindrical polishing tools.

3. A polishing and cleaning compound system according to claim 1, wherein a first cleaning process is carried out by pouring a liquid on said pair of said cylindrical polishing tools following the polishing process.

4. A polishing and cleaning compound system according to claim 2, wherein a first cleaning process is carried out by pouring a liquid on said pair of said cylindrical polishing tools following the polishing process.

5. A polishing and cleaning compound device according to claim 3, wherein the polishing process and the first cleaning process are overlapped for a specific period of time.

6. A polishing and cleaning compound device according to claim 4, wherein the polishing process and the first cleaning process are overlapped for a specific period of time.

7. A polishing and cleaning compound device according to claim 1, wherein said cleaning device unit comprises:

a plurality of second holders, each of which comprises at least three second rollers operable to rotate, wherein said second holders are arranged so as to contact a circumferential edge of the work pieces transported from the polishing device unit so as to hold the work pieces;

a circular transport mechanism in which said second holders are arranged circularly in a vertical direction and which makes the work piece move to a specific position;

cleaning tools which grip the work piece moved to the specific position by said transport mechanism and clean the work piece by rotating; and a cleaning device which makes the work piece rotate to carry out a cleaning process.

8. A polishing and cleaning compound device according to claim 2, wherein said cleaning device unit comprises:

a plurality of second holders, each of which comprises at least three second rollers operable to rotate, wherein said second holders are arranged so as to contact a circumferential edge of the work pieces transported from the polishing device unit so as to hold the work pieces;

a circular transport mechanism in which said second holders are arranged circularly in a vertical direction and which makes the work piece move to a specific position;

cleaning tools which grip the work piece moved to the specific position by said transport mechanism and clean the work piece by rotating; and a cleaning device which makes said work piece rotate to carry out a cleaning process.

9. A polishing and cleaning compound device according to claim 3, wherein said cleaning device unit comprises:

a plurality of second holders, each of which comprises at least three second rollers operable to rotate, wherein said second holders are arranged so as to contact a circumferential edge of the work pieces transported from the polishing device unit so as to hold the work pieces;

a circular transport mechanism in which said second holders are arranged circularly in a vertical direction and which makes the work piece move to a specific position;

cleaning tools which grip the work piece moved to the specific position by said transport mechanism and clean the work piece by rotating; and a cleaning device which makes said work piece rotate to carry out a second cleaning process.

10. A polishing and cleaning compound device according to claim 4, wherein said cleaning device unit comprises:

a plurality of second holders, each of which comprises at least three second rollers operable to rotate, wherein said second holders are arranged so as to contact a circumferential edge of the work pieces transported from the polishing device unit so as to hold the work pieces;

a circular transport mechanism in which said second holders are arranged circularly in a vertical direction and which makes the work piece move to a specific position;

cleaning tools which grip the work piece moved to the specific position by said transport mechanism and clean the work piece by rotating; and a cleaning device which makes said work piece rotate to carry out a second cleaning process.

11. A polishing and cleaning compound device according to claim 5, wherein said cleaning device unit comprises:

a plurality of second holders, each of which comprises at least three second rollers operable to rotate, wherein said second holders are arranged so as to contact a circumferential edge of the work pieces transported from the polishing device unit so as to hold the work pieces;

a circular transport mechanism in which said second holders are arranged circularly in a vertical direction and which makes the work piece move to a specific position;

cleaning tools which grip the work piece moved to the specific position by said transport mechanism and clean the work piece by rotating; and a cleaning device which makes said work piece rotate to carry out a second cleaning process.

12. A polishing and cleaning compound device according to claim 6, wherein said cleaning device unit comprises:

a plurality of second holders, each of which comprises at least three second rollers operable to rotate, wherein said second holders are arranged so as to contact a circumferential edge of the work pieces transported from the polishing device unit so as to hold the work pieces;

a circular transport mechanism in which said second holders are arranged circularly in a vertical direction and which makes the work piece move to a specific position;

cleaning tools which grip the work piece moved to the specific position by said transport mechanism and clean the work piece by rotating; and a cleaning device which makes said work piece rotate to carry out a second cleaning process.

* * * * *